United States Patent [19]

Chich

[11] Patent Number: 5,038,970

[45] Date of Patent: Aug. 13, 1991

[54] DISPENSING DEVICE

[75] Inventor: Robert H. Chich, Mequon, Wis.

[73] Assignee: DCI Marketing, Milwaukee, Wis.

[21] Appl. No.: 412,181

[22] Filed: Sep. 25, 1989

[51] Int. Cl.[5] ..... A47F 1/04

[52] U.S. Cl. ..... 221/307; 221/131; 312/43

[58] Field of Search ..... 221/304, 307, 308, 309, 221/310, 221, 223, 241, 243; 312/43

[56] References Cited

U.S. PATENT DOCUMENTS

| | | | |
|---|---|---|---|
| 1,280,692 | 10/1918 | Errett . | |
| 1,297,205 | 3/1919 | McLaren . | |
| 1,341,606 | 5/1920 | Wilson . | |
| 1,496,491 | 6/1924 | Ringler . | |
| 2,232,425 | 2/1941 | Balton | 312/43 |
| 2,606,087 | 8/1952 | Tansley | 312/43 |
| 3,163,323 | 12/1964 | Behrens et al. | 221/304 X |
| 3,435,987 | 4/1969 | Saunders et al. | 221/307 |
| 3,581,934 | 6/1971 | Sciascia | 221/304 |
| 3,790,023 | 2/1974 | Filipowicz | 221/304 |
| 4,319,696 | 3/1982 | Stevens | 312/43 X |
| 4,787,798 | 11/1988 | Padovani | 221/304 X |

*Primary Examiner*—H. Grant Skaggs
*Assistant Examiner*—Keith L. Dixon
*Attorney, Agent, or Firm*—Michael, Best & Friedrich

[57] ABSTRACT

A dispensing device for dispensing a supply of cups. The dispensing device includes a magazine which is adapted to house the supply of cups and also includes a dispensing assembly having a passageway associated with the magazine. Resilient members are supported to obstruct the passage of cups through the dispensing assembly. The orientation of the resilient members can be adjusted, moved, lengthened or shortened, to vary the amount of obstruction.

19 Claims, 2 Drawing Sheets

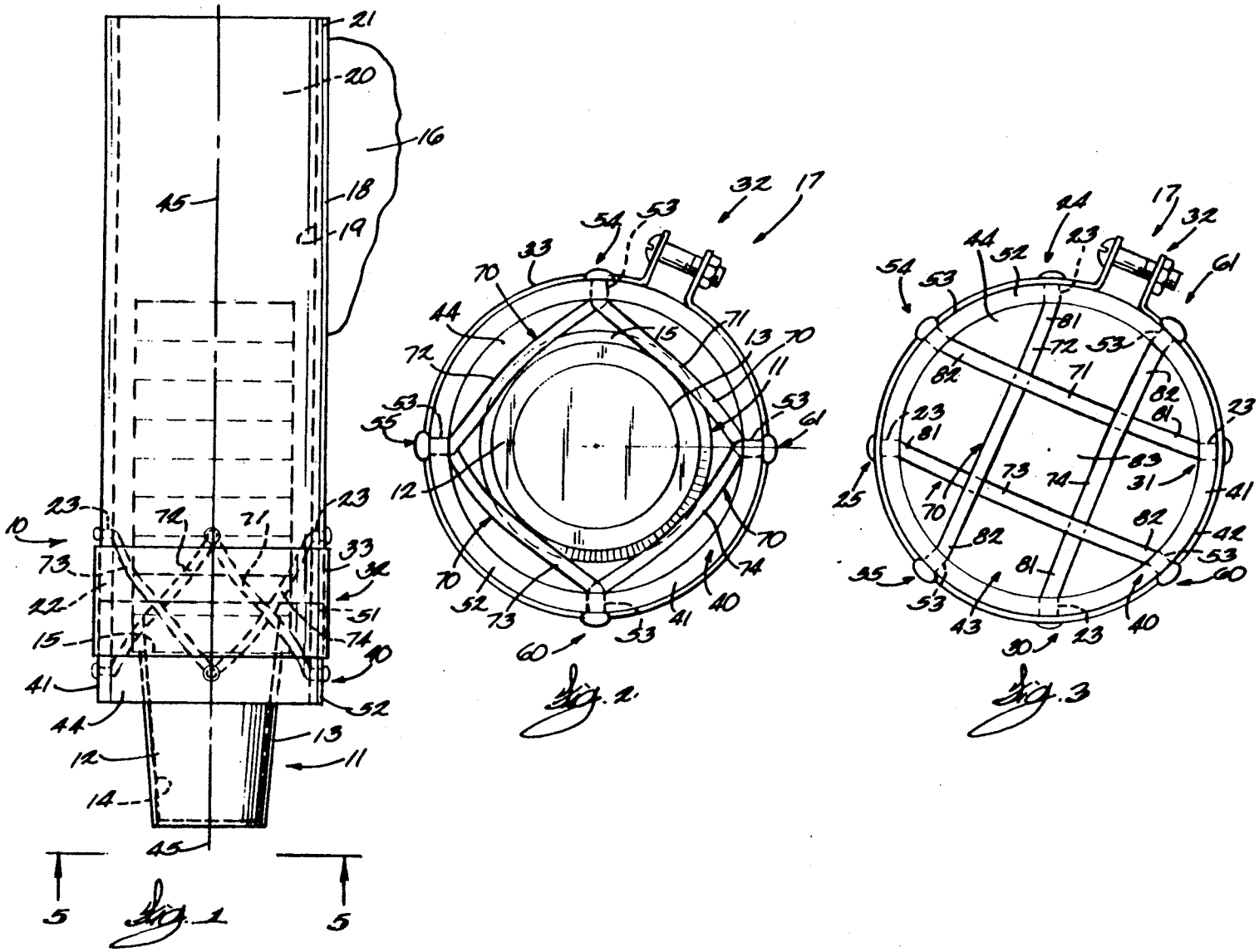

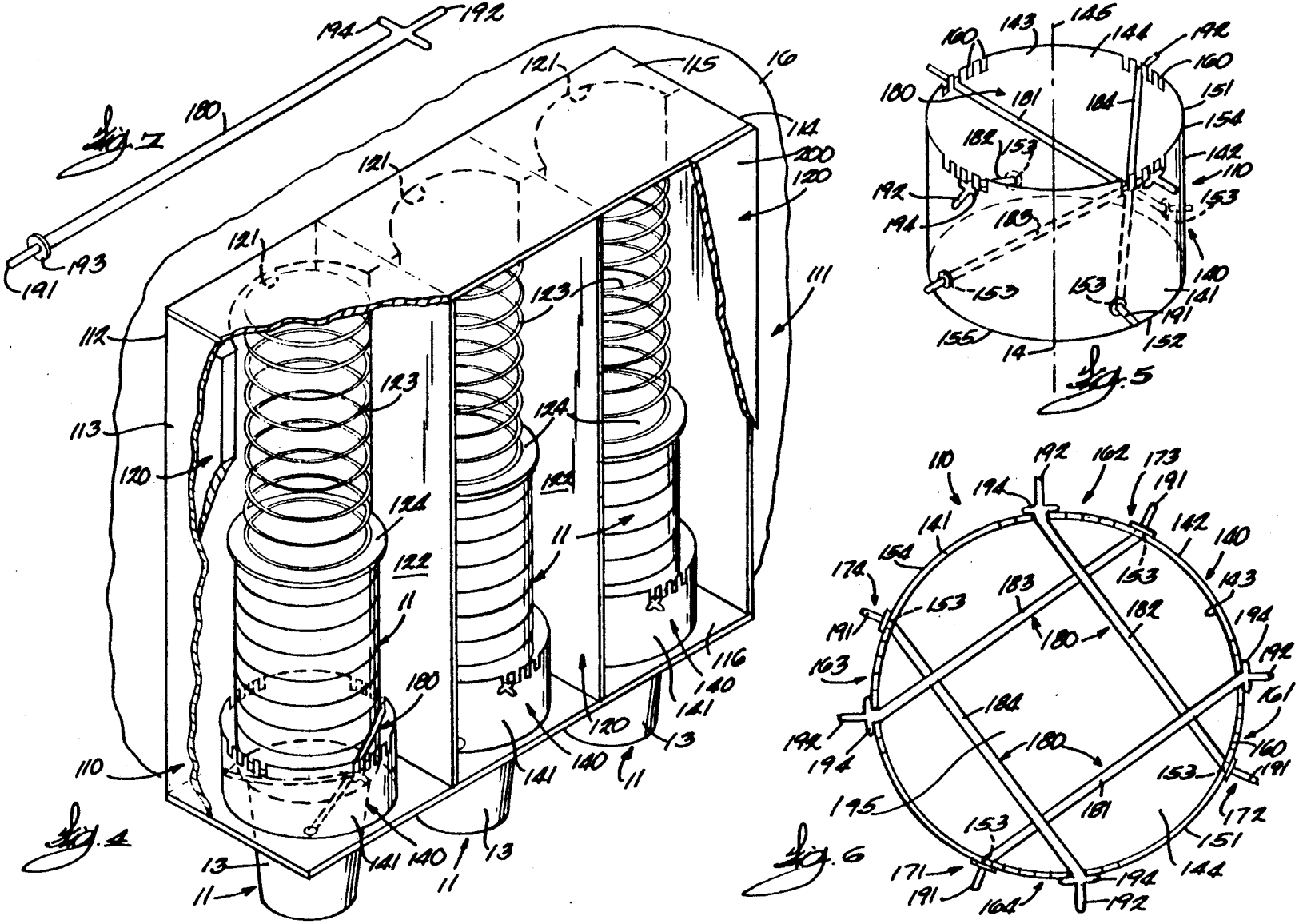

DISPENSING DEVICE

BACKGROUND OF THE INVENTION

1) Field of the Invention

The present invention relates to a dispensing device and, more particularly, to such a device which is operable to individually dispense objects such as disposable cups.

2) Description of the Prior Art

The prior art is replete with examples of cup dispensing devices which are operable to serially dispense nestable cups. Such devices are typically hung from a wall or rest atop a counter. The supply of disposable cups is contained within a tube, and are serially withdrawn from one end of the tube. Attempts have also been made to provide a cup dispensing device which may be adjusted so that it is capable of dispensing cups of different diameters. Examples of such devices are shown in U.S. Letters Patents No. 3,790,023 to Filipowicz and U.S. Pat. No. 3,435,987 to Saunders et al. Examples of other similar devices are discussed in greater detail in these references.

While the prior art devices have operated with varying degrees of success, they have been unsatisfactory in several important respects For example, they have sometimes failed when one of the components of the dispensing assembly is rendered either partially or totally inoperative. Further, such devices have been expensive to manufacture and/or difficult to repair. Other deficiencies of the prior art devices result from characteristics inherent in their individual designs. For example, the prior art assemblies may be difficult to adjust, or may be only marginally adjustable rendering them incapable of dispensing all commercially available cup sizes.

Therefore, it has long been known that it would be desirable to have a dispensing device which is adaptable to dispense nestable cups having a wide variety of diameters, and which further is simple to manufacture and maintain.

SUMMARY OF THE INVENTION

Therefore, it is an object of the present invention to provide an improved dispensing device.

Another object of the present invention is to provide such a dispensing device which is effective to dispense a supply of nestable cups.

Another object of the present invention is to provide such a dispensing device which includes a readily adjustable dispensing assembly.

For the achievement of these and other objects, this invention contemplates a dispensing device having a magazine adapted to channel a supply of cups into a dispensing assembly. The dispensing assembly includes at least a pair of elongated resilient members the opposite ends of which are supported so that one end is movable relative to the other. The resilient members define the opening through which the cups must pass to be removed from the magazine. When the movable end of the resilient members are moved relative to the other end, that opening is either increased or decreased depending upon the direction of movement, and thereby varying the amount of obstruction the resilient members offer to the interior of the dispensing device.

In a preferred embodiment, the dispensing device includes a plurality of slots individually formed around the magazine interior and one end of at least one of the resilient members is selectively and releasably secured in the individual slots. The selective positioning of that end of the resilient member in the individual slots establishes the extension of the resilient member across the interior of the magazine thereby defining the cup dispensing opening.

In yet another preferred embodiment, the opposite ends of the resilient members are attached one end to a respective one of two relatively movable members defining a part of the magazine and/or the dispensing assembly. When those members are moved one with respect to the other, the extension of the resilient member across the interior of the magazine is varied to thereby define the cup dispensing opening.

BRIEF DESCRIPTION OF THE DRAWINGS

FIG. 1 is a side elevation view of an embodiment of the invention.

FIG. 2 is a bottom plan view of the dispensing device taken along line 2—2 of FIG. 1.

FIG. 3 is a second bottom plan view of the dispensing device taken along line 2—2 of FIG. 1 and showing an alternative position for the dispensing device.

FIG. 4 is a fragmentary perspective view of an embodiment of the invention shown in a typical operative configuration.

FIG. 5 is a fragmentary, somewhat enlarged perspective view of a portion of the dispensing device of FIG. 4.

FIG. 6 is a plan view of the portion of the dispensing device shown in FIG. 4.

FIG. 7 is a perspective view of one of the resilient members used in the embodiment of FIGS. 4–6.

DESCRIPTION OF THE PREFERRED EMBODIMENT

Referring more particularly to FIG. 1 of the drawings, dispensing apparatus 10 is depicted as it would be configured for purposes of dispensing disposable styrofoam cups 11. The cups are of conventional construction, being nestable one within another and each having a main body 12 of substantially frusto-conical configuration. The main body 12 has an exterior surface 13, and an interior surface 14. Further, a circumscribing lip 15 is formed about the exterior surface of each of the cups.

The apparatus 10 will normally be mounted on a supporting surface such as being hung from a wall 16 by conventional fasteners, not shown. Means for housing and channeling the cups includes an elongated, substantially cylindrically shaped magazine 18. The magazine may be manufactured from assorted materials such as stainless steel or extruded plastics. The magazine has an interior cylindrical surface 19 which defines a bore 20 having a predetermined substantially uniform diameter throughout the axial length of the magazine.

The magazine has a first, intake end 21 which is adapted to receive the cups 11 to be dispensed, and a second, discharge end 22. As perhaps best illustrated in FIG. 2, a plurality of openings 23 are formed in the magazine 18 in predetermined positions adjacent to its second end 22. The openings are disposed in substantially equally spaced relation relative to each other. The individual openings operate as four points of attachment, 24, 25, 30 and 31, respectively, for individual resilient members as will hereinafter be discussed in greater detail.

Again referring to FIG. 1, clamping assembly 32 is mounted on the second end 22 of the magazine 18. The clamping assembly has a substantially cylindrical main body 33 and an adjustment assembly 17 consisting of turned ends of the body 33 and a nut/machine screw combination operable to reduce the inside diameter of the main body 33 such that the lower end of magazine 18 and a dispensing assembly 40 can be encircled by body 33 and secured in substantially coaxial alignment. More particularly, dispensing assembly 40, has a substantially cylindrical main body 41 with an outside surface 42 and an opposite, inside surface 43. The inside surface defines a cylindrical shaped passageway 44. Further, the passageway defined by the magazine and the dispensing assembly has a longitudinal axis which is generally indicated by the line labeled 45.

The dispensing assembly can be rotated relative to magazine 18 while being held in substantially coaxial alignment relative to the bore 20 of the magazine 18. The clamping assembly further is adapted to selectively secure the dispensing assembly in a predetermined rotated attitude relative to the magazine. This is accomplished by releasing the screw of the adjustment assembly 17 thereby permitting coaxial rotational movement of the dispensing assembly relative to magazine to a desired position and then tightening the screw-nut combination of the adjustment assembly thereby locking the dispensing assembly in a selected position.

The main body 41 of the dispensing assembly 40 has a first end 51 which abuts, or is otherwise closely adjacent to the second end 22 of the magazine 18. Body 41 has a second end 52. As is shown in FIG. 2, a plurality of openings 53 are formed into the main body 41 in close proximity to the second end 52. These openings provide points of attachment, 54, 55, 60 and 61, respectively for a plurality of resilient members 70.

Preferably, four resilient members 71, 72, 73 and 74 are provided and each has an elongated main body and first and second ends 81 and 82, respectively. The resilient members may be manufactured from assorted materials such as various elastomeric compounds, or metal springs so long as they are flexible and, as in the preferred embodiment, can expand and contract in an axial direction. Further, the resilient members may be rectangular, square, or substantially round in cross section.

As best seen in FIG. 3, the first end 81 of resilient member 71 is secured at opening 23, and the second end 82 is secured to opening 54. Similarly, end 81 of resilient member 72 is secured to the opening 24, and the second end 82 is secured to opening 55; the end 81 of resilient member 73 is secured to the opening 25 and the second end 82 is secured to the opening 60; and the end 81 of resilient member 74 is secured to opening 30 and the end 82 is secured to the opening 61.

When the openings in the magazine are displaced in a circumferential direction from the openings in the dispensing assembly, the resilient members extend across and partially obstruct the passage in the lower part of magazine 18 and the dispensing assembly and define an opening 83. When the dispensing assembly 40 is rotated relative to the magazine, it has the effect of positioning the respective resilient members in predetermined obstructing relation relative to the passageway 44. That is, such relative rotational movement either elongates or shortens and repositions the resilient members thereby varying the size of opening 83 and the amount of obstruction of the opening through the magazine and dispensing assembly. Further, and as best seen in FIG. 1, the openings 24, 25, 30 and 31 are spaced axially from openings 54, 55, 66 and 61 SO that individual resilient members are disposed in substantially nonorthogonal relation relative to the longitudinal axis 45 and in diagonal and tangential relation relative to the exterior surface of the cups 11. Also, because of the axial spacing upon relative rotational movement between the sets of openings, the amount by which the resilient members obstruct the central opening, and the size of opening 83 is varied as desired.

The opening 83 is disposed substantially centrally of the passageway 44 and receives the main body 12 of each of the cups 11. Coaxial rotational movement of the dispensing assembly 40 relative to the magazine 18 has the effect of constricting, or alternatively enlarging the opening 83 thereby permitting adjustment of the dispensing device 10 so as to permit dispensing cups of different diameters.

An alternative embodiment form of the invention is indicated by the numeral 11 in FIG. 4. This embodiment is similar in operation to the first embodiment 10. This embodiment includes a housing 111 that has a rear wall 112, and left and right side walls 113 and 114, respectively, which can be individually secured to a support wall. Further, the housing includes a top surface 115 and a bottom surface 116 which are connected to the left and right side walls, and to the rear wall to form a substantially rectangular container.

A plurality of channels, or magazines 120 are defined by substantially concavely shaped surfaces 121 which are mounted on, or otherwise formed as an integral part of, the rear wall. The individual channels, or magazines are separated from one another by dividing walls 122. Individual biasing springs 123 are dimensioned to be received in the individual magazines, and a plate 124 is mounted on one end of the biasing spring. The biasing spring and the plate are operable to urge a supply of cups 11 in to the dispensing assembly 140. A removable wall 200 completes the housing by closing the side opposite to back wall 120.

As best illustrated by reference to FIG. 5, the dispensing assemblies 140 each include a cylindrically shaped main body 141 that has an outside surface 142 and an opposite, inside surface 143. The inside surface defines a substantially cylindrically shaped passageway 144. Further, the passageway has a longitudinal axis 145. Each of the dispensing assemblies also has first and second ends 151 and 152. A plurality of openings 153 are formed in the main body 141 and are positioned in substantially equally spaced relation one to another and adjacent to the second end 152. The first end 151 of the dispensing assembly includes a peripheral edge 154, and the second end of the container includes a peripheral edge 155. A plurality of individual, elongated longitudinal slots 160, are formed in the peripheral edge 154. The slots are grouped into discrete sets 161, 162, 163, and 164, respectively. The individual sets are positioned in substantially equally spaced relation about the first end and are spaced axially from the openings 153. This relationship is seen most clearly by reference to FIG. 6.

The plurality of openings 153 define individual points of attachment 171, 172, 173, and 174 for a plurality of individual resilient members 180. Individual resilient members 181, 182, 183, and 184 are provided and each has an elongated main body with a first end 191, and an opposite, second end 192. As best illustrated by reference to FIG. 7, a circular, substantially flange shaped member 193 is formed as an integral part of each of the resilient members adjacent to the first end 191. Further, the respective resilient members include a bar shaped member 194 which is integral with the elongated main body adjacent to the second end 192. The flange 193 and the bar 194 provide lateral projections on the main body of the resilient members which are operable to secure each of the resilient members on the dispensing assembly 140.

More particularly, the resilient member 181 is threaded through opening 171 and is secured in place by the flange-shaped member 193 which engages the outside surface 142 of the dispensing assembly 140. The second end 192 of the first resilient member is selectively secured thereafter in one of the slots 160 which forms the first set of slots 161 circumferentially displaced from opening 171. In like fashion, resilient member 182 is secured at opening 172 and in one of the several slots 160 which make up the second set of slots 162. The third and fourth resilient members 163 and 164, are secured at openings 173 and 174, respectively, and are individually and selectively secured in the individual slots 160 which make up the third and fourth sets of slots 163 and 164, respectively.

As best seen by reference to FIG. 6, the individual resilient members 180 are again disposed in partially obstructing, nonorthogonal relation relative to the longitudinal axis 145 and the passageway 144 the same as in the previously discussed embodiment. Further, the individual resilient members define an opening 195 which is substantially centrally disposed relative to the passageway 144 and through which the individual cups 11 pass. As earlier discussed with respect to the first embodiment of the invention, the individual resilient members 180 are diagonally and tangentially disposed relative to the exterior surface 13 of the cups 11, and deform upon movement of the individual cups through the passageway 144 thereby allowing the cups to be dispensed. Further, the size of the opening 195 is changed by the movement of the second end 192 of each of the resilient members into selected slots 160. In this fashion, the dispensing assembly can be adjusted to permit the dispensing of cups 11 having different diameters.

The operation of the described embodiments of the present invention is believed to be readily apparent and will be briefly summarized at this point.

With respect to the first embodiment of the invention 10, the opening 83, through which the individual cups 11 pass, is adjusted, as to size, by the selective coaxial rotational movement of the dispensing assembly 40 relative to the magazine 18. This rotational movement of the magazine causes the individual resilient members 70 to move either towards, or alternatively away from the longitudinal axis 45, thereby restricting or enlarging the opening 83. This, of course, permits the dispensing assembly to be adjusted so as to accommodate cups having different diameters. That is, the relative position of the ends of the resilient members is selected to define an opening necessary to hold the cup stack at rest.

With respect to the second embodiment of the invention 110, the individual resilient members 180 are selectively positioned in predetermined partially obstructing relation relative to the passageway 144 by the movement of the individual resilient members into releasable engagement with individual slots 160. In this fashion, the opening 195 can be dimensioned so as to permit the dispensing assembly 140 to dispense cups having different diameters.

In both forms of the invention, the partially obstructing, nonorthogonally disposed resilient members 70 and 180, respectively, are disposed in diagonal, tangential relation relative to the exterior surface 13 of the cups 11. As the lowermost cup is urged or otherwise drawn through the passageways 44 and 144, respectively, by a user of the device, the resilient members deform to permit passage. During the deformation process, a greater portion of the main body of each of the resilient members is exposed to the exterior surface area of the respective cups 11. Therefore, as the individual cups are urged along the respective passageways, the frictional resistance increases. When the individual cups clear the passageway, the deformed resilient members quickly resume their shape grasping the next cup in the stack thereby preventing its removal from the stack as the lowermost cup is withdrawn.

The coil spring 123 in the second embodiment will urge the cup stack toward the dispensing assembly regardless of the orientation of the overall assembly.

Therefore, it will be seen that the two embodiments of the present invention have particular utility when employed to dispense nestable containers such as disposable cups. The dispensing device provides a fully dependable and practical means for selectively dispensing individual cups rapidly and conveniently while reducing to an absolute minimum the possibility of malfunction. The present invention is easily adjusted so as to permit the dispensing of containers having different diameters, and is further of sturdy and dependable construction and is relatively simple and easy to maintain.

Although the invention has been herein shown and described in what is conceived to be the most practical and preferred embodiments, it is recognized that departures may be made therefrom within the scope of the invention, which is not to be limited to the illustrated details disclosed.

I claim:

1. Apparatus for dispensing a work object comprising, in combination:

a dispensing assembly having an axis and an axially extending passageway formed therein, said passageway dimensioned to permit the movement of a work object therethrough, at least a pair of generally elongated, expandably resilient members, means defining first and second points of attachment for each of said resilient members within said dispensing assembly and said passageway with the points of attachment of each resilient member being spaced axially and peripherally relative to said dispensing assembly passage and each resilient member having an extension between said points of attachment so that said resilient members are disposed in obstructing relation relative to said passageway, said resilient members positioned to engage and restrain the movement of said work object in said passageway, and means for adjusting at least one point of attachment of each of said resilient members relative to its other point of attachment to vary the amount of obstruction so that said resilient members are adjustable to engage work objects of different diameters.

2. The apparatus of claim 1 including means positioned in coaxial alignment with said dispensing assembly passageway for channeling a plurality of work objects to said resilient members.

3. The apparatus of claim 1 including means defining an elongated storage space for work objects positioned in axial alignment with said dispensing assembly passageway, wherein said resilient members each include first and second ends, said first end being fixed relative to said dispensing assembly, and means for attaching said second end in a selected one of a plurality of peripherally spaced positions relative to said passageway.

4. The apparatus of claim 3 wherein said dispensing assembly one point of attachment of said resilient members is provided by means defining a plurality of openings in the portion of dispensing assembly defining said passageway, said openings relatively spaced around the periphery of said passageway, and wherein said second ends of resilient members are releasably engaged in a selective one of said openings.

5. The apparatus of claim 4 wherein said dispensing assembly includes a marginal edge and said openings are defined by a plurality of slots in said marginal edge.

6. The apparatus of claim 5 wherein said work objects are substantially frusto-conical shaped cups.

7. The apparatus of claim 4 including spring means mounted in said storage space for biasing said work objects toward said dispensing assembly.

8. The apparatus of claim 2 wherein one point of attachment of said resilient members is on said dispensing assembly and the other point of attachment of said resilient members is removed from and fixed relative to said dispensing assembly, and including means mounting said dispensing assembly for rotation relative to the fixed parts of attachment of said resilient members so that the orientation of said resilient members can be changed to vary the degree of obstruction of said passageway.

9. The apparatus of claim 8 wherein said fixed point of attachment of said resilient members is on said channeling means.

10. The apparatus of claim 8 including spring means mounted in said storage space for biasing said work objects toward said dispensing assembly.

11. A dispensing device for selectively dispensing a single cup from a stacked arrangement of cups comprising, in combination:

a housing, means in said housing defining an elongated storage space for a stack of cups, a dispensing assembly associated with said storage space for receiving said stack of cups, said dispensing assembly including wall means defining an internal passageway in alignment with said storage space, at least a pair of generally elongated, expandably resilient members, means attaching said resilient members within said passageway with one point of attachment of each of said resilient members on said wall means and a second point of attachment of each of said resilient members relative to the periphery of said passageway being spaced from said first point of attachment so that said resilient members extend in and obstruct said passageway, and means for adjusting one point of attachment of each of said resilient members relative to the other to thereby change the orientation of said resilient members and vary the amount of obstruction in said passageway.

12. The dispensing device of claim 11 wherein said wall means and said passageway are generally cylindrical, and wherein said points of attachment of each of said resilient members are relatively axially and circumferentially relative to said passageway.

13. The dispensing device of claim 12, wherein said means attaching said resilient members in said passageway includes a plurality of openings spaced circumferentially around said passageway for selectively receiving and anchoring said resilient member.

14. The dispensing device of claim 13, wherein said wall means includes a marginal edge and said plurality of openings comprising slots in said marginal edge, and including means defining a second group of openings spaced axially from slots and providing the other point of attachment of said resilient members.

15. The apparatus of claim 14 including spring means mounted in said storage space for biasing said work objects toward said dispensing assembly.

16. The apparatus of claim 13 wherein one point of attachment of said resilient members is on said dispensing assembly and the other point of attachment of said resilient members is removed from and fixed relative to said dispensing assembly, and including means mounting said dispensing assembly for rotation relative to the fixed parts of attachment of said resilient members so that the orientation of said resilient members can be changed to vary the degree of obstruction of said passageway.

17. The dispensing device of claim 16 wherein said fixed point of attachment of said resilient members is on said means defining said storage space.

18. The apparatus of claim 17 including spring means mounted in said storage space for biasing said work objects toward said dispensing assembly.

19. Apparatus for dispensing a work object comprising, in combination, a dispensing assembly having a generally cylindrical passageway therein, said passageway dimensioned to permit the movement of a work object therethrough in the direction of the axis of said cylindrical passageway, at least a pair of generally elongated resilient members, means defining first and second points of attachment for each of said resilient members within said dispensing assembly and said passageway with the points of attachment of each resilient member being spaced axially and peripherally relative to said dispensing assembly passage and each resilient member having an extension between said points of attachment so that said resilient members are disposed in obstructing relation relative to said passageway, said resilient members positioned to engage and restrain the movement of said work object in said passageway, and means for moving at least one point of attachment of each of said resilient members relative to its other point of attachment to vary the length of the resilient members in said cylindrical opening and correspondingly vary the amount of obstruction in said cylindrical opening so that said resilient members are adjustable to engage work objects of different diameters.

* * * * *